US008084403B2

(12) United States Patent
Lam et al.

(10) Patent No.: US 8,084,403 B2
(45) Date of Patent: Dec. 27, 2011

(54) LUBRICANT FORMULATIONS AND METHODS

(75) Inventors: William Y. Lam, Glen Allen, VA (US); Gregory H. Guinther, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 133 days.

(21) Appl. No.: 12/434,150

(22) Filed: May 1, 2009

(65) Prior Publication Data

US 2010/0279902 A1 Nov. 4, 2010

(51) Int. Cl.
*C10M 137/10* (2006.01)

(52) U.S. Cl. ..... 508/369; 508/371

(58) Field of Classification Search ..... 508/369, 508/371

See application file for complete search history.

(56) References Cited

U.S. PATENT DOCUMENTS

| | | | | |
|---|---|---|---|---|
| 2,837,549 | A | 6/1958 | Reeves | |
| 3,284,354 | A | 11/1966 | Tunkel et al. | |
| 4,214,067 | A | 7/1980 | Packer | |
| 5,380,448 | A | 1/1995 | Kadkhodayan et al. | |
| 5,384,054 | A | 1/1995 | Kadkhodayan | |
| 5,627,294 | A | 5/1997 | Adams et al. | |
| 6,074,993 | A | 6/2000 | Waddoups et al. | |
| 6,245,719 | B1 | 6/2001 | Kobori | |
| 6,300,291 | B1 | 10/2001 | Hartley et al. | |
| 6,333,298 | B1 | 12/2001 | Waddoups et al. | |
| 7,462,583 | B2 | 12/2008 | Wilk et al. | |
| 7,867,957 | B2 * | 1/2011 | Matsui et al. | 508/192 |
| 2004/0033908 | A1 | 2/2004 | Deckman et al. | |
| 2004/0106527 | A1 | 6/2004 | Pace et al. | |
| 2004/0121918 | A1 | 6/2004 | Rea et al. | |
| 2005/0107269 | A1 * | 5/2005 | Yagishita et al. | 508/440 |
| 2008/0015129 | A1 | 1/2008 | Al-Ahmad et al. | |
| 2008/0125336 | A1 * | 5/2008 | Loper et al. | 508/364 |
| 2008/0125337 | A1 * | 5/2008 | Guinther et al. | 508/369 |
| 2008/0236538 | A1 | 10/2008 | Lam | |

FOREIGN PATENT DOCUMENTS

| | | | |
|---|---|---|---|
| EP | 0768366 | A1 | 4/1997 |
| JP | 2004197002 | A1 | 7/2004 |

OTHER PUBLICATIONS

Shubkin, R. L. "Polyalphaolefins," CRC Handbook of Lubrication and Tribology, vol. III, CRC Press, Inc., Boca Raton, FL, 1994, pp. 219-235.

Born, M; Hipeaux, J. C.; Parc, G., The Relationship Between Chemical Structure and Effectiveness of Some Metallic Dialkyl- and Diaryl-dithiophosphates in Different Lubricated Mechanisms, Lubrication Science, No. 4-2, 1992, pp. 93-116.

* cited by examiner

*Primary Examiner* — Glenn Caldarola

(74) *Attorney, Agent, or Firm* — Luedeka, Neely & Graham, P.C.

(57) ABSTRACT

The embodiments described herein relate to particular formulations and methods that provide reduced engine deposits. The lubricant composition includes a base oil having a NOACK volatility of from about 5 to about 15 and a zinc dialkyl dithio phosphate composition. The zinc dialkyl dithio phosphate composition has at least about 65 mole percent of zinc dialkyl dithio phosphate compounds derived from all primary alcohols, wherein the zinc dialkyl dithio phosphate composition has greater than about 40 mole percent zinc dialkyl dithio phosphate compounds having alkoxy moieties derived from alcohols having four carbon atoms.

18 Claims, No Drawings

LUBRICANT FORMULATIONS AND METHODS

TECHNICAL FIELD

The embodiments described herein relate to particular formulations and methods that provide improved lubricant performance and enhance engine deposit ratings.

BACKGROUND AND SUMMARY

For over fifty (50) years automotive engine oils have been formulated with zinc dialkyl dithio phosphate (ZDDP) resulting in low levels of wear, oxidation, and corrosion. The additive is truly ubiquitous and found in nearly every modern engine oil. ZDDP may impart multifunctional performance in the areas of anti-wear, anti-oxidation, and anti-corrosion and is considered one of the most cost-effective additives in general use by engine oil manufacturers and marketers.

However, not all ZDDP's are effective for improving lubricant performance without the formation of unwanted piston deposits. In general, there are three primary classes of ZDDP's in common use in engine oils, ZDDP's made with primary alcohols, ZDDP's made with secondary alcohols, and ZDDP's made with a mixture of primary and secondary alcohols. Also, mixtures of all primary alcohol ZDDP with all secondary alcohol ZDDP have been used. In addition to the alkoxy moiety derived from primary or secondary alcohols, the alcohol chain length may also have an effect on lubricant performance. Accordingly, there may be an unlimited number of combinations of primary and secondary alcohol ZDDP's with varying chain lengths that are potentially useful for engine lubricant applications. Some combinations of ZDDP's may increase piston deposit formation and some combinations of ZDDP's may decrease engine deposit formation. Accordingly, what is needed is a ZDDP product composition that provides enhances lubricant performance and does not increase piston deposit formation.

In view of the above, an embodiment of the disclosure provides a lubricant composition for reducing engine deposits. The lubricant composition includes a base oil having a NOACK volatility of from about 5 to about 15 and a zinc dialkyl dithio phosphate composition. The zinc dialkyl dithio phosphate composition has at least about 65 mole percent of zinc dialkyl dithio phosphate compounds derived from all primary alcohols, wherein the zinc dialkyl dithio phosphate composition has greater than about 40 mole percent zinc dialkyl dithio phosphate compounds having alkoxy moieties derived from alcohols having four carbon atoms.

In another embodiment a lubricant composition may include a base oil having a NOACK volatility of from about 5 to about 15 and a zinc dialkyl dithio phosphate composition having from about 15 to about 30 mole percent of zinc dialkyl dithio phosphate compounds derived from alcohols having five carbon atoms.

Yet another embodiment of the disclosure may provide a method for decreasing piston deposits in an internal combustion engine. The method includes lubricating the engine with a lubricant composition having therein a base oil having a NOACK volatility of from about 5 to about 15, and a zinc dialkyl dithio phosphate composition. The zinc dialkyl dithio phosphate composition has at least about 65 mole percent of zinc dialkyl dithio phosphate compounds derived from all primary alcohols, wherein the zinc dialkyl dithio phosphate composition has greater than about 40 mole percent zinc dialkyl dithio phosphate compounds having alkoxy moieties derived from alcohols having four carbon atoms.

Another embodiment of the disclosure provides a method for engine deposits in an internal combustion engine. The method includes lubricating the engine with a lubricant composition having therein a base oil having a NOACK volatility of from about 5 to about 15 and a zinc dialkyl dithio phosphate composition having from about 15 to about 30 mole percent of zinc dialkyl dithio phosphate compounds derived from alcohols having five carbon atoms.

The compositions and methods described may be particularly suitable for improving engine deposit ratings over combinations of ZDDP compounds that do not contain a sufficient amount of ZDDP compounds made with primary alcohols or that have a lower mole percentage of alkoxy moieties derived from alcohols having more than 5 carbon atoms. Other features and advantages of the compositions and methods described herein may be evident by reference to the following detailed description which is intended to exemplify aspects of the embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION

Lubricant compositions according to embodiments described herein may comprise a base oil and a zinc dialkyl dithio phosphate composition, wherein the zinc dialkyl dithio phosphate composition has at least about 65 mole percent of zinc dialkyl dithio phosphate compounds derived from all primary alcohols, and wherein the zinc dialkyl dithio phosphate composition has greater than about 40 mole percent zinc dialkyl dithio phosphate compounds having alkoxy moieties derived from alcohols having four carbon atoms.

The lubricant compositions may be suitable for use in a variety of applications, including but not limited to engine oil applications and/or heavy duty engine oil applications. Examples may include the crankcase of spark-ignited and compression-ignited internal combustion engines, automobile and truck engines, marine and railroad diesel engines, and the like.

The lubricant compositions may comprise a base oil and one or more suitable additive components. The additive components may be combined to form an additive package which is combined with the base oil. Or, alternatively, the additive components may be combined directly with the base oil.

Base Oil

Base oils suitable for use with present embodiments may comprise one or more oils of lubricating viscosity such as mineral (or natural) oils, synthetic lubricating oils, vegetable oils, and mixtures thereof. Such base oils include those conventionally employed as crankcase lubricating oils for spark-ignited and compression-ignited internal combustion engines, such as automobile and truck engines, marine and railroad diesel engines, and the like. Suitable base oils may have a NOACK volatility of from about 5 to about 15. As another example, suitable base oils may have a NOACK volatility of from about 10 to about 15. As even further example, suitable base oils may have a NOACK volatility of from about 9 to about 13. Base oils are typically classified as Group I, Group II, Group III, Group IV and Group V, as described in Table 1 below.

TABLE 1

| Group I-V Base Oils | | | | |
|---|---|---|---|---|
| Base Oil | % Sulfur | | % Saturates | Viscosity Index |
| Group I | >0.03 | and/or | <90 | 80-120 |
| Group II | ≦0.03 | and/or | ≧90 | 80-120 |
| Group III | ≦0.03 | and/or | ≧90 | ≧120 |
| Group IV | * | | | |
| Group V | ** | | | |

* Group IV base oils are defined as all polyalphaolefins

** Group V base oils are defined as all other base oils not included in Groups I, II, III and IV and may include gas to liquid base oils.

Lubricating base oils may also include oils made from a waxy feed. The waxy feed may comprise at least 40 weight percent n-paraffins, for example greater than 50 weight percent n-paraffins, and more desirably greater than 75 weight percent n-paraffins. The waxy feed may be a conventional petroleum derived feed, such as, for example, slack wax, or it may be derived from a synthetic feed, such as, for example, a feed prepared from a Fischer-Tropsch synthesis.

Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Mineral base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

ZDDP Component

Lubricant compositions disclosed herein may comprise a zinc dialkyl dithio phosphate (ZDDP) compositions that may include one or more ZDDP compounds. Suitable ZDDPs compounds may be prepared from specific amounts of primary alcohols, secondary alcohols, and mixtures of primary and secondary alcohols. The ZDDP compounds may also be combined to provide ZDDP compositions having primary-to-secondary alkoxy moiety ratios that range from about 100:0 to about 65:35. As an even further example, the ZDDP compounds may be combined so that the mole ratio of primary to secondary alkoxy moieties ranges from about 95:5 to about 70:30.

In addition to selecting ZDDP's made from primary and/or secondary alcohols, certain alkoxy moiety chain lengths are more suitable than others for ZDDP compositions that are effective for reducing engine deposits. For example, a ZDDP composition according to the disclosure may contain alkoxy moieties derived from alcohols having from about 3 to about 12 carbon atoms. For example, a suitable ZDDP composition may comprise a mixture of ZDDP compounds having alkoxy moieties derived from about 40 to about 70 mole percent of alcohols having four carbon atoms, from about 15 to about 30 mole percent of alcohols having five carbon atoms, from about 0 to about 30 percent of alcohols having six carbon atoms, and from about 5 to about 35 mole percent of alcohols having 8 carbon atoms. A particularly suitable ZDDP compound for use with a mixture of ZDDP compounds is a ZDDP compound derived from an alcohol having five carbon atoms In one embodiment, the ZDDP composition of the disclosure contains at least about 15 mole percent of the ZDDP compound derived from an alcohol having five carbon atoms. Of the foregoing ZDDP compounds, the alcohols having four, five, or eight carbon atoms are suitably primary alcohols that may be linear or branched alcohols and the alcohols having six carbon atoms are suitably secondary alcohols that may be linear or branched alcohols.

Another criteria for the proper selection of ZDDP compounds for use in the mixture of ZDDP compounds may be the average number of carbon atoms in the ZDDP composition. The average number of carbon atoms is determined by the number of carbon atoms in the alkoxy moieties of each of the ZDDP compounds according to the following formula:

$$\text{Avg carbon atoms}=2[(x \text{ mol \%.\#C in ZDDP1})+(y \text{ mol \%.\#C in ZDDP2})+(z \text{ mol \%.\#C in ZDDP3})+\ldots]$$

For the purposes of this disclosure, the average number of carbon atoms in the ZDDP composition, as determined by the foregoing formula, is desirably at least 9.0. The lubricant composition may comprise a ZDDP composition in an amount sufficient to contribute from about 0.01 wt % to about 0.15 wt % phosphorus to the lubricant composition. The phosphorus-containing component may comprise any suitable phosphorus-containing component such as, but not limited to a phosphorus sulfide. Suitable phosphorus sulfides may include phosphorus pentasulfide or tetraphosphorus trisulfide.

Optional Components

The lubricant compositions described herein may comprise one or more additional additive components. Suitable additive components may include, but are not limited to dispersants, oxidation inhibitors (i.e., antioxidants), friction modifiers, viscosity modifiers, rust inhibitors, demulsifiers, pour point depressants, antifoamants, and seal swell agents.

Representative effective amounts of the ZDDP compounds and other additives for providing a lubricant composition according to the disclosure are listed in Table 1 below. All the values listed are stated as weight percent active ingredient.

TABLE 2

| Component | Wt. % (Broad) | Wt. % (Typical) |
|---|---|---|
| Dispersant | 0.5-10.0 | 1.0-5.0 |
| Oxidation Inhibitors | 0-10.0 | 0.1-6.0 |
| Metal Detergents | 0.1-15.0 | 0.2-8.0 |
| Corrosion Inhibitor | 0-5.0 | 0-2.0 |
| Antifoaming agent | 0-5.0 | 0.001-0.15 |
| Pour point depressant | 0.01-5.0 | 0.01-1.5 |
| Viscosity modifier | 0.01-20.00 | 0.25-10.0 |
| ZDDP compounds | 0.1-10.0 | 0.25-5.0 |
| Base oil | Balance | Balance |
| Total | 100 | 100 |

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 20% by weight based on the weight of the lubricating oil composition.

The additives may be added directly to the lubricating oil composition. In one embodiment, however, an additive package is diluted with a substantially inert, normally liquid organic diluent such as mineral oil, synthetic oil, naphtha, alkylated (e.g. $C_{10}$ to $C_{13}$ alkyl)benzene, toluene or xylene to form an additive concentrate. The concentrates usually contain from about 1% to about 100% by weight and in one embodiment about 10% to about 90% by weight of the additive mixture.

The use of ZDDP compositions according to the above exemplified compositions have been to provide lubricant compositions that do not exhibit an increase in engine deposits, in particular the ZDDP compositions as described herein provide higher piston deposit ratings than may be achieved with ZDDP compositions falling outside of the disclosed ranges and types particularly when compared with other ZDDP compositions in a Sequence IIIG engine test.

EXAMPLES

The following examples are given for the purpose of exemplifying aspects of the embodiments and are not intended to limit the embodiments in any way. Inventive and comparative fully formulated lubricant compositions were tested in Sequence IIIG engine test and the results are given in the following table.

As shown in the foregoing table 3 (Samples 4-6), the formulations according to the disclosure had significantly higher piston deposit ratings than Comparative Samples 1-3 in the Sequence IIIG engine test.

At numerous places throughout this specification, reference has been made to a number of U.S. Patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

TABLE 3

| Component | Comparative Sample 1 | Comparative Sample 2 | Comparative Sample 3 | Sample 4 | Sample 5 | Sample 6 |
|---|---|---|---|---|---|---|
| Conventional Components | 17.51 | 17.51 | 17.51 | 17.51 | 17.51 | 17.51 |
| ZDDP (C6) Secondary | — | 0.76 | — | 0.28 | — | — |
| ZDDP (C8) Primary | — | 0.22 | — | — | | 0.24 |
| ZDDP (C3 + C6) Secondary | 0.95 | — | — | — | — | — |
| ZDDP (C3 + C4 + C8) Primary and Secondary | — | — | 0.93 | — | — | — |
| ZDDP (C4 + C5 + C8) Primary | — | — | — | 0.68 | 0.98 | 0.78 |
| Process Oil | 0.54 | 0.51 | 0.56 | 0.53 | 0.51 | 0.47 |
| Base Oil | 81.00 | 81.00 | 81.00 | 81.00 | 81.00 | 81.00 |
| P (ppm) | 772 | 798 | 789 | 772 | 788 | 771 |
| Seq. IIIG Engine Test Results | | | | | | |
| 100 Hr Vis Increase | 115.7 | 1155 | 86.6 | 84.6 | 108.2 | 113.3 |
| Wghted Piston Deposit | 3.20 | 3.00 | 3.46 | 3.86 | 4.12 | 5.17 |
| Avg. Cam & Lifter Wear | 13.9 | 27.6 | 25.7 | 12.0 | 20.2 | 20.3 |
| Oil Consumption | 4.03 | 3.69 | 3.36 | 3.77 | 3.78 | 3.56 |
| Hot Stuck Ring | 0 | 0 | 0 | 0 | 0 | 0 |
| ZDDP Primary to Secondary Mole Ratio | | | | | | |
| | Mole % | Mole % | Mole % | Mole % | Mole % | Mole % |
| Primary | | | | | | |
| C4 | — | — | 40 | 45.5 | 65 | 52 |
| C5 | — | — | — | 17.5 | 25 | 20 |
| C8 | — | 18 | 20 | 7.0 | 10 | 28 |
| Secondary | | | | | | |
| C3 | 50 | — | 40 | — | — | — |
| C6 | 50 | 82 | — | 30 | — | — |
| Avg. # C. Atoms | 9.0 | 12.7 | 8.8 | 10.1 | 9.3 | 10.6 |

What is claimed is:

1. A lubricant composition for reducing engine deposits comprising:

(a) a base oil having a NOACK volatility of from about 5 to about 15; and (b) a zinc dialkyl dithio phosphate composition comprising at least about 65 mole percent of zinc dialkyl dithio phosphate compounds derived from all primary alcohols, wherein the zinc dialkyl dithio phosphate composition comprises greater than about 40 mole percent zinc dialkyl dithio phosphate compounds having alkoxy moieties derived from primary alcohols having four carbon atoms and at least 15 mole percent of zinc dialkyl dithio phosphate compounds having alkoxy moieties derived from primary alcohols having five carbon atoms and wherein the average number of carbon atoms in the zinc dialkyl dithio phosphate composition is greater than about 9.0 and the zinc dialkyl dithio phosphate provides from about 0.01 to about 0.15 wt. % phosphorus to the lubricant composition.

2. The lubricant composition of claim 1, wherein the lubricant composition is an engine oil.

3. The lubricant composition of claim 1, wherein the lubricant composition is a heavy duty engine oil.

4. The lubricant composition of claim 1, wherein the base oil comprises a mineral oil, a synthetic oil, or a mixture thereof.

5. The lubricant composition of claim 1, wherein the base oil comprises on or more of a member selected from the group consisting of: a group I base oil, a group II base oil, a group III base oil, a group IV base oil, and a group V base oil.

6. The lubricant composition of claim 1, wherein zinc dialkyl dithio phosphate composition comprises from about 15 to about 30 mole percent of zinc dialkyl dithio phosphate compounds having alkoxy moieties derived from primary alcohols having five carbon atoms.

7. The lubricant composition of claim 1, wherein the zinc dialkyl dithio phosphate composition in the lubricant composition further comprises from about 30 mole % or less zinc dialkyl dithio phosphate compounds having alkoxy moieties derived from secondary alcohols.

8. The lubricant composition of claim 1, wherein the zinc dialkyl dithio phosphate composition in the lubricant composition comprises from about 20 mole % or less zinc dialkyl dithio phosphate compounds having alkoxy moieties derived from secondary alcohols.

9. The lubricant composition of claim 1, wherein the lubricant composition comprises from about 0.01 wt % to about 0.1 wt % phosphorus provided by the zinc dialkyl dithio phosphate composition.

10. The lubricant composition of claim 1, wherein the zinc dialkyl dithio phosphate composition in the lubricant composition comprises 95 mole % or more zinc dialkyl dithio phosphate compounds having alkoxy moieties derived from primary alcohols.

11. The lubricant composition of claim 10, wherein the zinc dialkyl dithio phosphate composition is substantially devoid of zinc dialkyl dithio phosphate compounds having alkoxy moieties derived from secondary alcohols.

12. A lubricant composition comprising (a) a base oil having a NOACK volatility of from about 5 to about 15 and (b) a zinc dialkyl dithio phosphate composition comprising from about 15 to about 30 mole percent of zinc dialkyl dithio phosphate compounds derived from primary alcohols having five carbon atoms and greater than about 40 mole percent zinc dialkyl dithio phosphate compounds having alkoxy moieties derived from primary alcohols having four carbon atoms wherein the average number of carbon atoms in the zinc dialkyl dithio phosphate composition is greater than about 9.0 and the zinc dialkyl dithio phosphate provides from about 0.01 to about 0.15 wt. % phosphorus to the lubricant composition.

13. The lubricant composition of claim 12, wherein the zinc dialkyl dithio phosphate composition comprises zinc dialkyl dithio phosphate compounds selected from the group consisting essentially of zinc dialkyl dithio phosphate compounds having alkoxy moieties derived from all primary alcohols, zinc dialkyl dithio phosphate compounds having alkoxy moieties derived from all secondary alcohols, and zinc dialkyl dithio phosphate compounds having alkoxy moieties derived from primary alcohols and secondary alcohols.

14. A method for operating an internal combustion engine, comprising lubricating the engine with a lubricant composition comprising:

(a) a base oil having a NOACK volatility of from about 5 to about 15; and (b) a zinc dialkyl dithio phosphate composition comprising at least about 65 mole percent of zinc dialkyl dithio phosphate compounds derived from all primary alcohols, wherein the zinc dialkyl dithio phosphate composition comprises greater than about 40 mole percent zinc dialkyl dithio phosphate compounds having alkoxy moieties derived from primary alcohols having four carbon atoms and at least 15 mole percent of zinc dialkyl dithio phosphate compounds having alkoxy moieties derived from primary alcohols having five carbon atoms and the average number of carbon atoms in the zinc dialkyl dithio phosphate composition is greater than about 9.0 and the zinc dialkyl dithio phosphate provides from about 0.01 to about 0.15 wt. % phosphorus to the lubricant composition.

15. The method of claim 14, wherein the zinc dialkyl dithio phosphate composition in the lubricant composition further comprises from about 30 mole % or less zinc dialkyl dithio phosphate compounds having alkoxy moieties derived from secondary alcohols.

16. The method of claim 14, wherein the zinc dialkyl dithio phosphate composition in the lubricant composition comprises 95 mole % or more zinc dialkyl dithio phosphate compounds having alkoxy moieties derived from primary alcohols.

17. A method for operating an internal combustion engine, comprising lubricating the engine with a lubricant composition comprising:

(a) a base oil having a NOACK volatility of from about 5 to about 15; and (b) a zinc dialkyl dithio phosphate composition comprising from about 15 to about 30 mole percent of zinc dialkyl dithio phosphate compounds derived from primary alcohols having five carbon atoms and greater than about 40 mole percent zinc dialkyl dithio phosphate compounds having alkoxy moieties derived from primary alcohols having four carbon atoms wherein the average number of carbon atoms in the zinc dialkyl dithio phosphate composition is greater than about 9.0 and the zinc dialkyl dithio phosphate provides from about 0.01 to about 0.15 wt. % phosphorus to the lubricant composition.

18. The method of claim 17, wherein the zinc dialkyl dithio phosphate composition comprises from about 30 mole % or less zinc dialkyl dithio phosphate compounds having alkoxy moieties derived from secondary alcohols and at least about 65 mole percent of zinc dialkyl dithio phosphate compounds having alkoxy moieties derived from primary alcohols.

* * * * *